US005273097A

United States Patent [19]

Siegler

[11] Patent Number: 5,273,097

[45] Date of Patent: Dec. 28, 1993

[54] OVERLAPPED TABBED SHADE

[75] Inventor: Raymond Siegler, Allegheny County, Pa.

[73] Assignee: Verosol USA Inc., Pittsburgh, Pa.

[21] Appl. No.: 979,564

[22] Filed: Nov. 20, 1992

[51] Int. Cl.[5] ..... E06B 3/94

[52] U.S. Cl. ..... 160/84.1 R

[58] Field of Search ..... 160/84.1, 35, 370.2, 160/279, 32, 237, 134, 84.2, 84.3; 428/116, 118

[56] References Cited

U.S. PATENT DOCUMENTS

| | | | |
|---|---|---|---|
| 2,254,820 | 9/1941 | Donner | 160/84.1 |
| 2,350,094 | 5/1944 | Butts . | |
| 3,946,788 | 3/1976 | van Muyen . | |
| 4,544,011 | 10/1985 | Sawamura | 160/84.1 |
| 4,953,610 | 9/1990 | Phillips et al. . | |
| 4,974,656 | 12/1990 | Judkins | 160/84.1 |
| 5,092,383 | 3/1992 | Niemeijer et al. | 160/84.1 |

FOREIGN PATENT DOCUMENTS 0058459 8/1982 European Pat. Off. .

*Primary Examiner*—David M. Purol

*Attorney, Agent, or Firm*—Buchanan Ingersoll

[57] ABSTRACT

A window shade assembly having first and second sheets of pleated material. Each sheet has a plurality of transverse pleats disposed thereon. The pleats of each sheet are alternatingly directed in opposite directions to one another so that each sheet has a series of inward pleats disposed on one face and series of outward pleats disposed on an opposite face. Each outward pleat of the first and second sheets of material has a tab formed on its end. The outward pleats of one of or both the first and second sheets of material further have a transverse slit located adjacent to the tab. The first and second sheets are then overlappingly positioned relative to one another by each outward pleat of one sheet being disposed within a corresponding slit of the other sheet such that a portion of the second sheet overlaps the first sheet. Preferably, cord holes are placed at opposite sides of each tab such that the holes of the first and second sheet overlap when the first and second sheet are overlappingly positioned. Each hole is sized to accommodate a lift cord to be disposed therethrough.

11 Claims, 6 Drawing Sheets

OVERLAPPED TABBED SHADE

BACKGROUND OF THE INVENTION

1. Field of the Invention

This invention relates generally to window shade structures and more particularly to window shade structures having pleated shade panels.

2. Description of the Prior Art

Foldable or pleated window shade panels have become increasingly popular because of the aesthetically pleasing look of the pleated shades as well as the efficient manner in which the shades can collapse at the pleats when the shade is stacked during the raising of the shade. Such foldable window shades are made from fabric panels available in standard widths. The widest fabric panels are narrower than many window widths. Because of the limitations on fabric making equipment, it is not practical to produce wider fabric panels. Therefore, despite the advantages of such pleated shades, they may not always be used with some windows.

One way in which the industry has attempted to overcome the restrictions of standard width sizes is to attach two or more shade panels side by side so as to effectively increase the width of the entire shade panel structure. One such example of this attempt can be found in U.S. Pat. No. 3,946,788 to van Muyen. Van Muyen provides a plurality of pleated shade sections that are overlapped somewhat. The shade panel sections of van Muyen each have cord holes provided at opposite sides thereof. When van Muyen overlaps his shade panel sections, the holes are aligned so that lift cords may be provided through a vertical series of aligned holes.

Pleated window shades are known in the art in which the shades are provided with tabs formed on each pleat. Tabbed window shades are shown in U.S. Pat. No. 4,974,656 to Judkins. Such tabs formed on the pleats provide the shade construction with a location through which to run lift cords, the lift cord and lift cord holes being invisible from the front of the shade. The tabs also enhance energy efficiency and prevent light leakage by eliminating the need to place cord holes through the shade panels. The tabs also make the pleats stronger and more durable and are less likely to pull out in use, as well as enhancing the rigidity of the shade panels. Whether the pleated shade panels are tabbed or untabbed, there remains the restriction of the standard width of the shade panels.

When using the tabbed shades, it is not possible to simply overlap the shade panels to create the added width. This is because the tabs prevent the front face of one panel from mating with a rear face of another panel. Therefore, window shades having tabs and that are wider than the standard fabric panel widths are presently unavailable in the industry.

SUMMARY OF THE INVENTION

I provide a window shade assembly in which two or more tabbed pleated shade panels may be joined to create a window covering structure having a greater effective width. The present window shade assembly has first and second sheets of pleated material. Each sheet has a plurality of transverse pleats disposed thereon. The pleats of each sheet are alternatingly directed in opposite directions to one another so that each sheet has a series of inward pleats disposed on one face thereon and a series of outward pleats disposed on an opposite face thereon. Each of the outward pleats of the first and second sheets of material have a tab formed on the end thereof. The outward pleats of the second sheet of material further have a transverse slit provided thereon adjacent to the tab. The first and second sheets are then overlappingly positioned relative to one another by each first sheet outward pleat being disposed within a corresponding second sheet slit such that a portion of the second sheet overlaps the first sheet.

Preferably, cord holes are placed at opposite sides of each tab such that the holes of the first and second sheet overlap when the first and second sheet are overlappingly positioned. Each hole is sized to accommodate a lift cord to be disposed therethrough. Alternatively, the first and second sheets may be adhered together into the overlapped position.

Although two overlapped sheets are shown in the preferred embodiment, any number of sheets overlapped according to the teachings of the present invention may be employed. A second preferred embodiment utilizes three sheets of material having two overlaps.

Other details, objects and advantages of the invention will become apparent as the following description of certain present preferred embodiments thereof proceeds.

DETAILED DESCRIPTION OF THE PREFERRED EMBODIMENT

Figure 1:
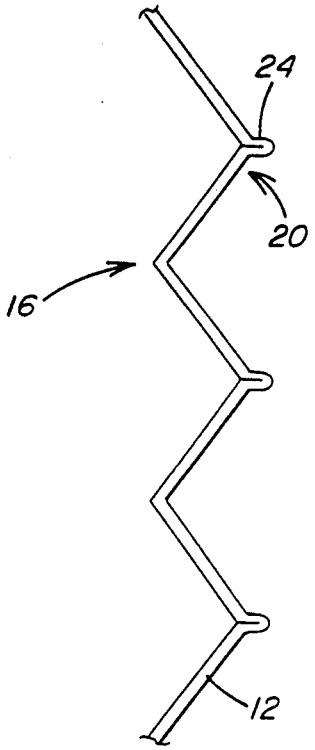
FIG. 1 is a side view of a pleated, tabbed sheet of material utilized in the present shade assembly.
Figure 5:
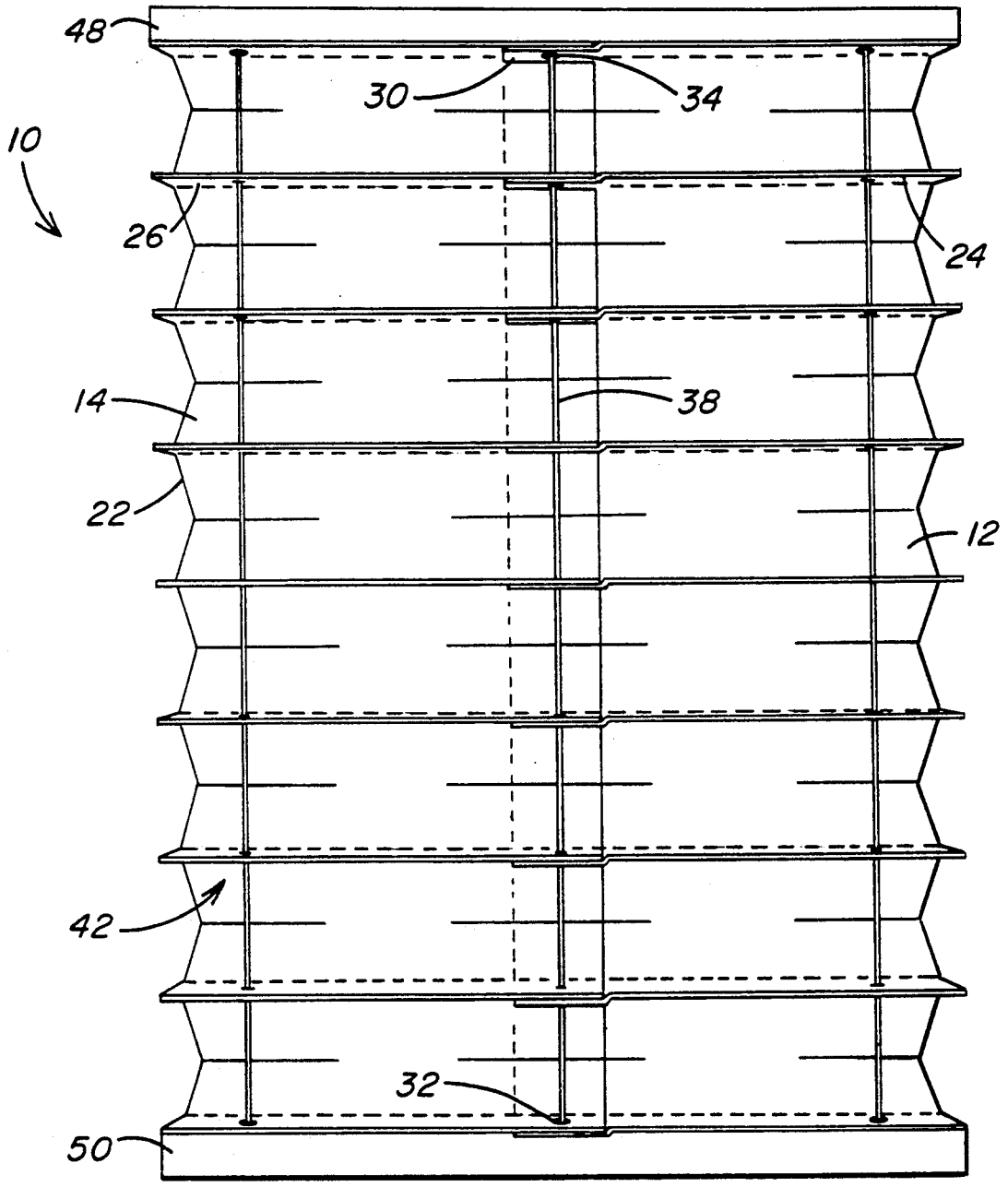
FIG. 5 is a rear view of the present window shade.
Figure 6:
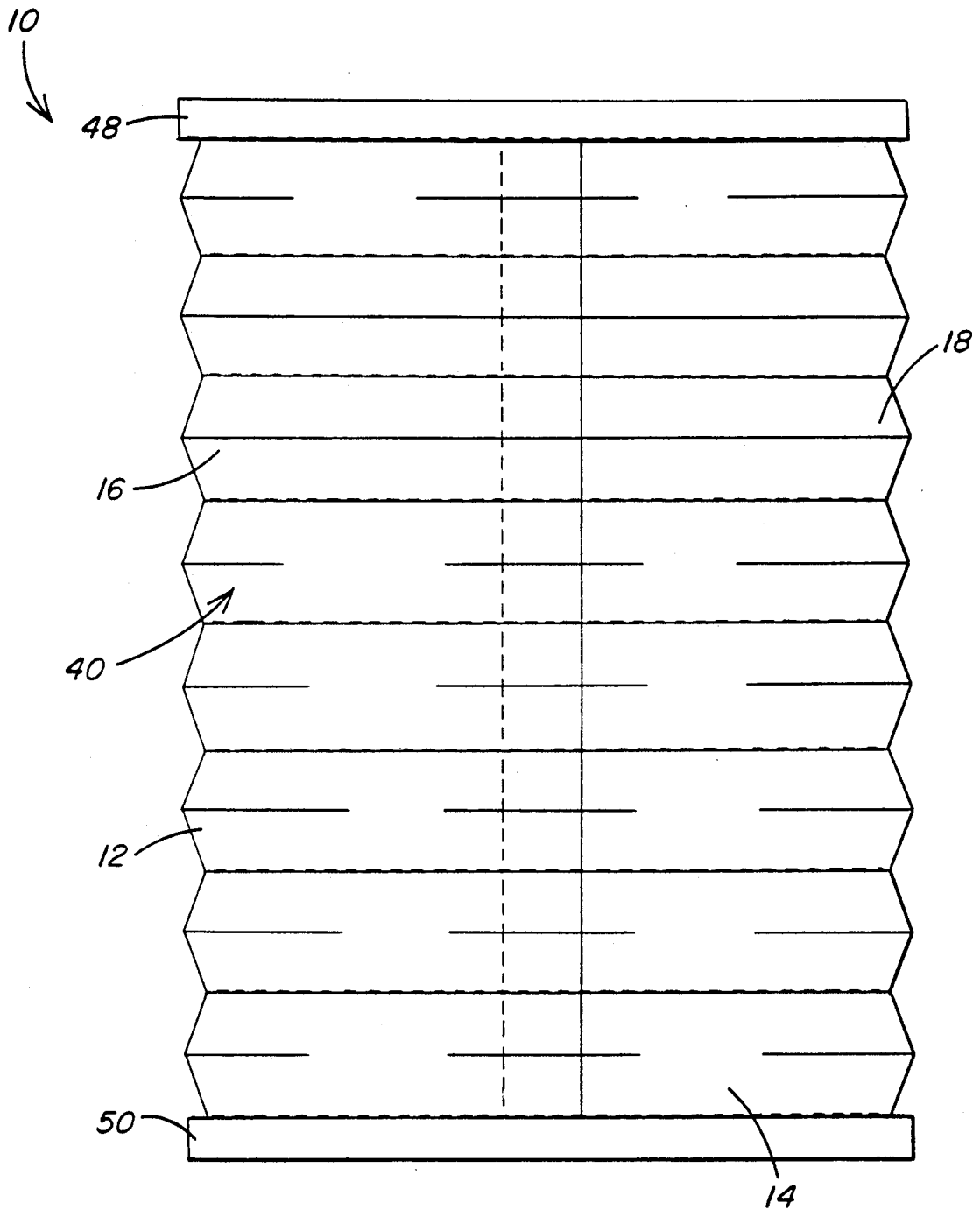
FIG. 6 is a front view of the window shade of FIG. 5.

Referring first to FIGS. 1, 5 and 6, a preferred window shade assembly 10 is shown. At least two sheets of pleated, tabbed material 12, 14 are overlapped along respective sides. The tops of the overlapped sheets 12, 14 are affixed to a headrail 48 and the bottoms of the overlapped sheets 12, 14 are affixed to a bottomrail 50. A lift cord 38 is then extended through the overlapped portions of the sheets and is affixed to the bottomrail 50 by any convenient means.

Referring particularly to FIG. 1, a pleated first sheet of material 12 is shown. The first sheet 12 has a plurality of transverse creases or pleats disposed thereon. The pleats may be formed by prefolding the sheets. The pleats are alternatingly directed in opposite directions to one another so as to have a series of inward pleats 16 disposed on one face thereon and a series of outward pleats 20 disposed on an opposite face thereon. Each of the outward pleats 20 have a tab 24 formed on the end thereof.

The sheets of material may be fabricated from any suitable material such as nylon or cloth. In addition, the sheets may have a metalized layer placed on them to improve their insulation quality. Furthermore, a coating of any material that is stiff and has good adhesion may be applied to the sheets. The coating may be applied to an entire surface of each sheet or may be sprayed on the pleats while the fabric is tightly stacked so that only the creased area is coated. Some examples of possible coating materials are acrylic or vinyl based coatings. Such coating may improve not only the insulation quality of the sheets, but may also improve the strength and memory of the pleats.

Figure 2:
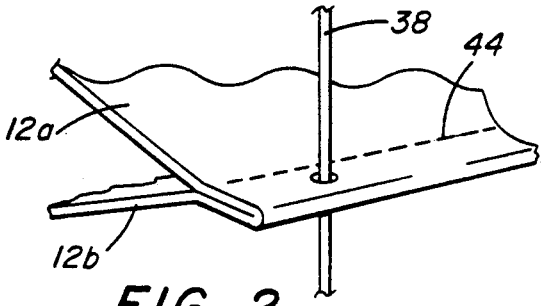
FIG. 2 is a perspective view of a portion of a shade showing a tab.

In accordance with the teachings of this invention and as may be seen best in FIG. 2, the two sections of material 12*a* and 12*b* forming each of the outward pleats 20 are secured together along a bond line 44 extending along substantially the entire width of the shade panel and at a point a short distance from the pleat end to form each tab. The bond line 44 which results in the tab 24 may be formed by welding, sewing, gluing or by other suitable means. Preferably, the bond line 44 is formed by ultrasonic welding. The length of the tabs 24 will vary with application and the dimensions of the sheets of shade material.

The memory, strength and rigidity of the pleats may be significantly enhanced by providing a multiple bond or a continuous bond between the fabric layers forming each tab. Alternatively, the two sections, of material forming each of the outward pleats 20 may be adhered together over substantially the entire area.

Figure 2A:
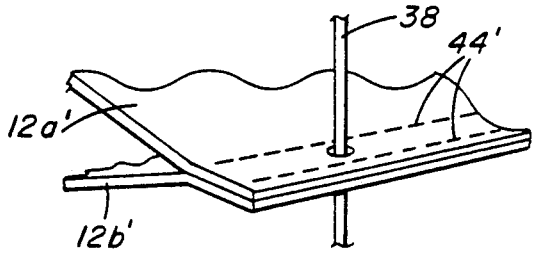
FIG. 2A is a perspective view of a portion of a shade showing an alternative tab.

Referring to FIG. 2A, an alternative bond may be formed on the sheets. A bond joint, in this case a double weld joint 44' such as that shown in FIG. 2, is being utilized to splice together two pieces of material 12*a'* and 12*b'* rather than to merely secure together two sections 12*a* and 12*b* of the same piece of material. Therefore, single or multiple bond lines may be provided to form the tabs. Thus, each shade panel may be a continuous sheet of fabric or may be a sheet of fabric formed by the splicing of separate pieces of fabric. The joint still results in the formation of a tab 24 that may have cord holes 32 formed therein through which a lift cord 38 may pass. The pieces of material may be spliced together by any suitable means.

Figure 7:
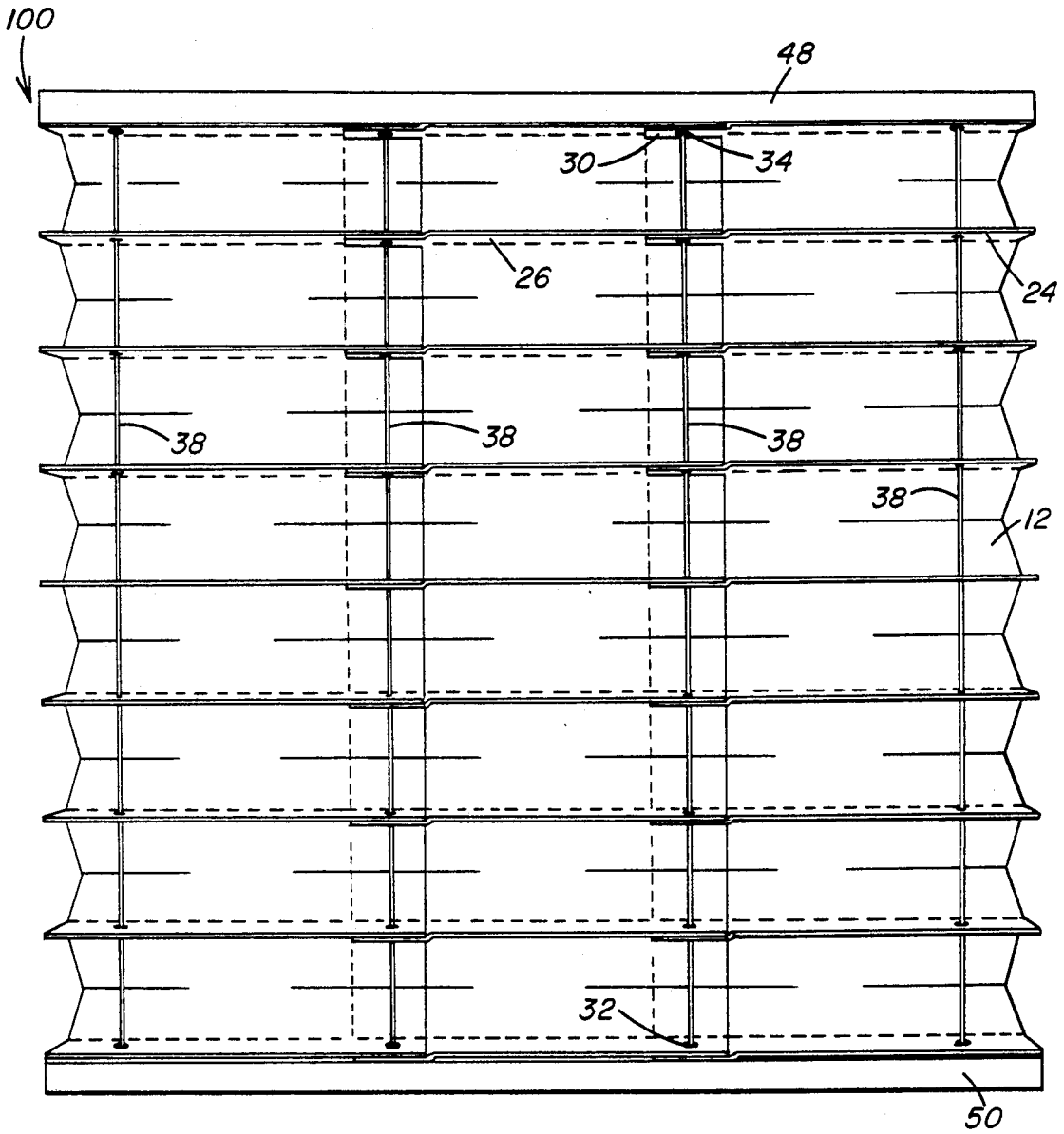
FIG. 7 is a rear view of a second preferred embodiment of the present window shade.

The formation of the tabs 24 has been to this point discussed in terms of the outward pleats 20 of the first sheet of material 12. However, it is understood that the second sheet of material 14 also has tabs 26 formed thereon in the above-described manner on its outward pleats 22. Furthermore, any number of sheets of pleated, tabbed material may be provided and overlappingly joined to one another in the described manner. To demonstrate this point, a second preferred shade assembly 100 is shown in FIG. 7 that utilizes three sheets of material having two overlaps.

Figure 3:
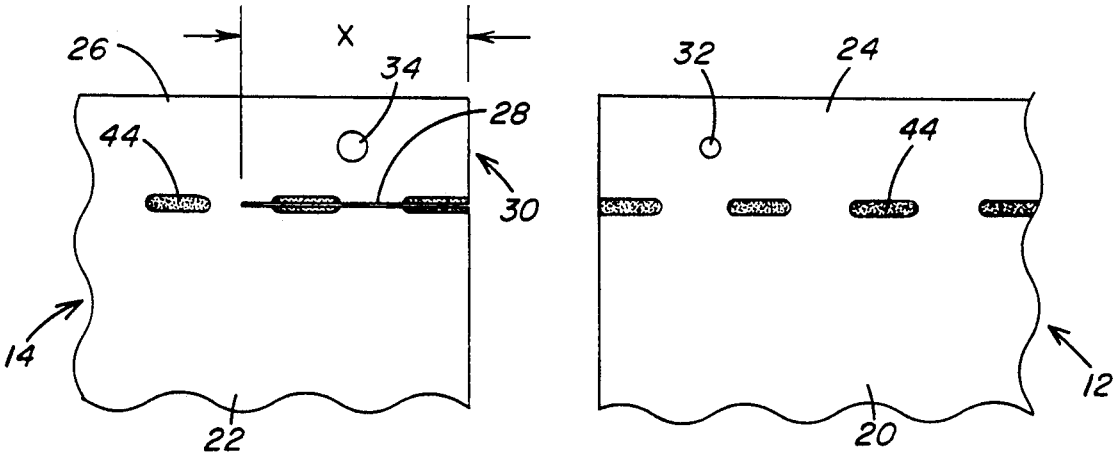
FIG. 3 is a plan view of a portion of a pleat of the first sheet and a corresponding pleat of the second sheet.

Referring next to FIG. 3, a portion of the outward pleats 20, 22 of the first sheet 12 and the second sheet 14 are shown. On the outward pleat 20 of the first sheet of material 12, a first tab 24 is formed. Tab 24 is formed by the outward pleat 20 being bonded at bond line 44. A cord hole 32 is disposed through the first sheet tab 24 at a selected distance from a side of the first sheet.

Similarly, the outward pleat 22 of the second sheet of material 14 has a tab 26 formed thereon. Tab 26 is formed by the pleat being bonded at bond line 44. A transverse slit 28 is then placed on the second sheet outward pleat 22. The slit 28 may be formed by cutting, tearing or otherwise slicing the sheet. The transverse slit 28 extends from one side of the second sheet longitudinally a selected distance shown as X in FIG. 3. The preferred length of slit 28 is about ¾ of one inch. Thus, the portion of the second sheet tab 26 that extends from the side of the second sheet to the end of the transverse slit 28 may act as a flap and may be moved away from the plane on which the remaining portion of the second sheet tab 26 resides. This flap tab portion 30 preferably has a cord hole 34 disposed therethrough. The longitudinal slit 28 also preferably extends along the center of the bond line 44.

The bond line 44 is preferably wide enough such that the sections of material forming each outward pleat are bonded together on either side of the slit 28. And if multiple bond lines 44 are utilized in the formation of the tabs 24 and 26, the slits 28 are preferably placed between the bond lines 44. This prevents separation of the pleat and the tab on either side of the slit.

The first sheet 12 and the second sheet 14 are then overlappingly positioned relative to one another with each first sheet outward pleat 20 being disposed within a corresponding transverse slit 28 on the second sheet 14. The first sheet outward pleat 20 is disposed within the entire length of the transverse slit 28. Thus, the length of the overlap between the first sheet 12 and the second sheet 14 is approximately equal to the length of the transverse slit 28. When the first sheet 12 and the second sheet 14 are placed in an overlapping position, the flap tab portion 30 overlaps a selected length of the first sheet tab 24. The flap tab portion 30 is preferably placed on the underside of the first sheet tab 24.

The cord holes 34 and 32 have been placed respectively on the flap tab portion 30 and the first sheet tab 24 at a selected distance such that when the first sheet outward pleat 20 is disposed fully within the transverse slit 28, the two cord holes 32, 34 overlap. Each cord hole is sized to accommodate a lift cord to be disposed therethrough. Thus, when cord holes 32 and 34 are overlapped, a single lift cord 38 may be run mutually through the cord holes 32, 34 for each pleat (as can be seen in FIG. 5). The overlapped cord holes 32, 34 of each pleat are arranged so that a vertical series of overlapped cord holes are placed in the structure of each pair of overlapped sheets. The cord holes 32, 34 may not be the same diameter in size. In fact, it is preferred that the cord hole 34 on the flap tab portion 30 be larger than the cord hole 32 on the first sheet tab 24. This is performed to reduce friction between lift cord 38 and the cord holes 32, 34. The lift cord 38 placed through each series of overlapped cord holes 32, 34 not only acts to raise and lower the window shade structure, but also to keep the sheets of material 12, 14 in position relative to one another. Thus, no adhesive is needed in this embodiment to keep the sheets of material 12, 14 together. Each sheet of material also preferably has two sets of aligned cord holes at cpposite ends of the sheet to provide a vertical path for the lift cords, as shown in the figures. Additional sets of aligned cord holes may be provided between the ends of the sheets as desired. Thus, there are several aligned series of cord holes having a cord disposed therethrough on the assembly.

Once the sheets 12, 14 have been secured in the overlapped position, the tabs 24, 26 are not visible from the front 40 of the shade assembly, as can be seen best in FIG. 6. Additionally, the overlapped portions are held in abutment so that no light passes between them. The lift cord 38, cord holes 32, 34 and tabs 24, 26 are located at the rear 42 of the shade assembly and are thus not in view when the front 40 of the shade assembly is directed towards the interior of the room.

Figure 8:
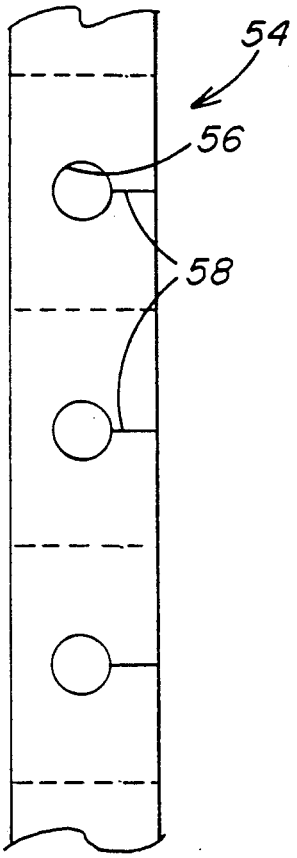
FIG. 8 is a front view of a portion of a strip suitable for use with the preferred shade assembly.
Figure 9:
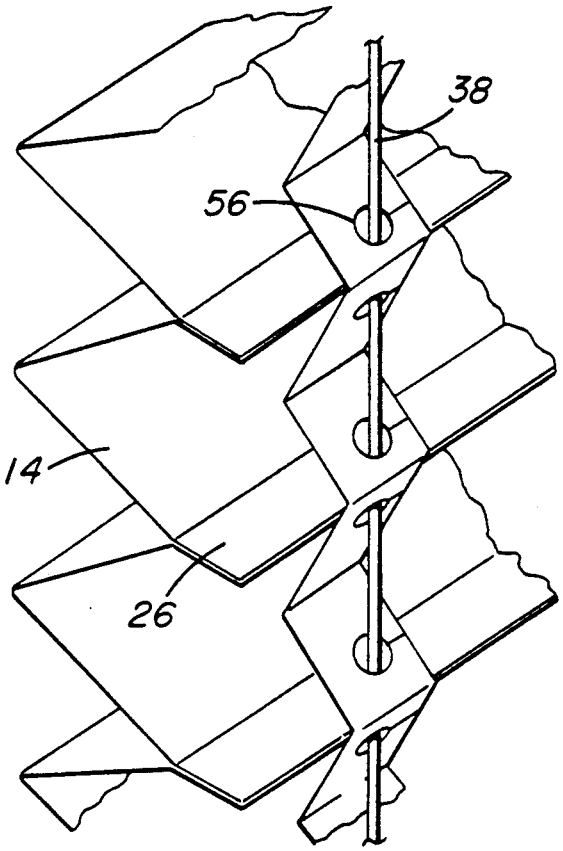
FIG. 9 is a rear side perspective view of a portion of the strip of FIG. 8 cooperating with the portion of the preferred shade assembly.

A strip 54 of pleated material shown in FIGS. 8 and 9 may be provided at selected locations in the shade assembly to allow for an even stack of fabric when the shade assembly is raised. The shade assembly might have an uneven stack when raised because the portions of the shade assembly at the lift cords where the sheets are overlapped will have more material than at the lift cords at the far sides of the assembly where there is no overlapped sheets. Thus, when the lift cords raise the assembly into a stack, the stack will be thicker at the overlapped area than at the sides. Strips 54 of pleated material are therefore located adjacent the sheets of material at the series of cord holes at the far sides of the assembly. The strips 54 have cord holes 56 placed in them. The strips 54 also have a selected cord hole spacing and pleat length such that each strip cord hole 56 overlaps a corresponding cord hole on the sheet of material. With the strips positioned alongside the sheets, the stack will have an even thickness at the lift cords. The strips 54 may be sized and configured to overlay the tabbed pleats on the rear face of the sheets, or may have a simple accordion pleat and be affixed to the front face of the sheets. The lift cord running through both the sheet cord holes and the strip cord holes will keep the strips in position relative to the sheets. Alternatively, the strips 54 may be adhered to the sheets. The strips 54 may be placed adjacent the sheets before the lift cords are disposed through the assembly or the strips may be slid into position after the lift cords are run through the assembly by being provided with slits 58 at each cord hole 56.

Variations of the preferred embodiment could be made. For example, although the invention has been described by demonstrating the overlap of a first and a second sheet of material, it is distinctly understood that any number of sheets of material may be overlapped in the manner described above. Multiple sheets could be overlapped by having slits formed on only one side of each sheet, or by providing slits on both sides of each sheet of material.

Figure 4:
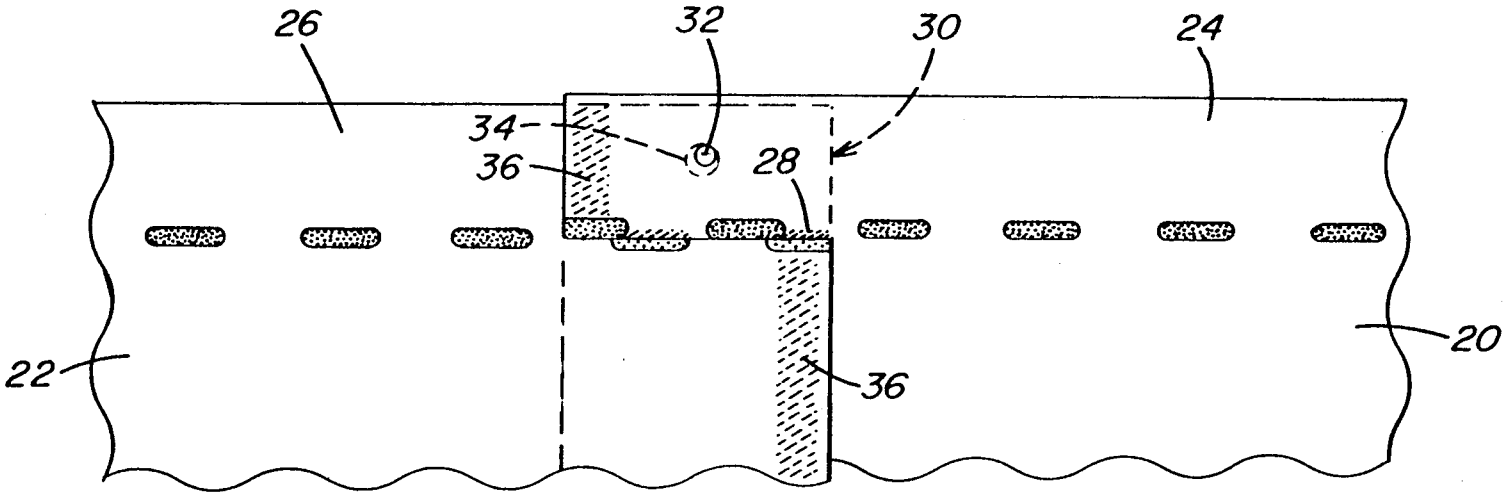
FIG. 4 is a view similar to FIG. 3 in which the pleats are in an overlapped position.

Also, although it is preferred that no adhesive be used to keep the overlapped sheets of material together, the sheets may be kept together with an adhesive 36 placed between the sheets as shown in FIG. 4. Any suitable adhesive may be used. In this alternative, the cord holes need not be placed through the overlapped tabs, but may be placed at any location along the tabs of each sheet.

Also, the overlapped sheets of material may be provided with compatible decorative patterns on them to help provide the appearance of a single sheet of pleated material.

While present preferred embodiments of the invention have been shown, it is distinctly understood that the invention is not limited thereto but may be otherwise variously embodied within the scope of the following claims.

I claim:

1. A window shade assembly, comprising:

a first and a second sheet of pleated material arranged side by side to one another, each sheet having a plurality of transverse pleats disposed thereon, the pleats being alternatingly directed in opposite directions to one another so that each sheet has a series of inward pleats disposed on one face thereon and a series of outward pleats disposed on an opposite face thereon, each sheet outward pleat having a tab formed thereon, each outward pleat of at least one of the first and second sheet further having a transverse slit of a selected length provided thereon adjacent to the tab, wherein the first and second sheets are overlappingly positioned relative to one another by a portion of each outward pleat of one sheet being disposed within a corresponding slit of the other sheet such that a portion of the face of the first sheet overlaps the second sheet.

2. The window shade structure of claim 1 wherein each tab has at least one cord hole disposed thereon, each cord hole being sized to accommodate a lift cord disposed therethrough, the first sheet cord holes and second sheet cord holes being positioned on the respective first sheet tabs and second sheet tabs so as to align when the first and second sheets are overlappingly positioned.

3. The window shade structure of claim 1 wherein the first and second sheets are adhered in an overlapped position.

4. A window shade assembly, comprising:

a plurality of sheets of pleated material arranged side by side to one another, each sheet having a plurality of transverse pleats disposed thereon, the pleats being alternatingly directed in opposite directions to one another so that each sheet has a series of inward pleats disposed on one face thereon and a series of outward pleats disposed on an opposite face thereon, each sheet outward pleat having a tab formed thereon, at least one side of each outward pleat of each sheet further having a transverse slit of a selected length provided thereon adjacent to the tab, wherein each adjacent two sheets are overlappingly positioned relative to one another by a portion of each outward pleat of one sheet being disposed within a corresponding slit of an adjacent sheet such that a portion of the face of each sheet overlaps an adjacent sheet.

5. The window shade structure of claim 4 wherein each tab has at least one cord hole disposed therein, each cord hole being sized to accommodate a lift cord disposed therethrough, the cord holes of each sheet being positioned so as to align when the sheets are overlappingly positioned, forming a vertical series of cord holes through the overlapped sheets.

6. The window shade structure of claim 4 wherein the tabs are formed by bonding together each outward pleat along the entire width of the pleat.

7. The window shade structure of claim 6 wherein the pleats are bonded by two generally parallel bond lines.

8. The window shade structure of claim 6 wherein the pleats are bonded by a single bond line.

9. The window shade structure of claim 8 wherein the slit is provided centrally through the bond line such that the pleat remains bonded on both sides of the slit.

10. The window shade structure of claim 5 further comprising two vertical series of aligned cord holes, each series of cord holes placed through the tabs of a portion of a sheet that is not overlapped with another sheet, the series of cord holes further being located at the respective sides of the shade structure.

11. The window shade structure of claim 10 further comprising two strips of pleated material, each strip having a series of cord holes disposed therethrough, each strip further being placed against a face of the shade structure at respective sides of the shade structure upon nonoverlapped portions of a sheet, with the pleats of the strips corresponding to the pleats of the sheets such that the cord holes of each strip overlap the cord holes of the sheets.

* * * * *